US007052389B2

(12) United States Patent
Honda et al.

(10) Patent No.: US 7,052,389 B2
(45) Date of Patent: May 30, 2006

(54) AIR SHOWER APPARATUS

(75) Inventors: Takeshi Honda, Nakajo (JP); Yoko Shimizu, Niigata (JP); Hiroshi Matsuda, Arakawa (JP); Hiroshi Mukai, Ishioka (JP)

(73) Assignees: Hitachi, Ltd., Tokyo (JP); Hitachi Industrial Equipment Systems Co., Ltd., Chiba (JP)

( * ) Notice: Subject to any disclaimer, the term of this patent is extended or adjusted under 35 U.S.C. 154(b) by 0 days.

(21) Appl. No.: 11/075,794

(22) Filed: Mar. 10, 2005

(65) Prior Publication Data

US 2005/0159100 A1 Jul. 21, 2005

Related U.S. Application Data

(63) Continuation of application No. 10/382,834, filed on Mar. 7, 2003, now Pat. No. 6,960,128.

(30) Foreign Application Priority Data

Dec. 3, 2002 (JP) ..... 2002-350630

(51) Int. Cl.
*F24F 7/07* (2006.01)

(52) U.S. Cl. ..... 454/187; 454/285

(58) Field of Classification Search ..... 454/285, 454/153, 187, 305, 121, 127; 34/666
See application file for complete search history.

(56) References Cited

U.S. PATENT DOCUMENTS 4,393,602 A * 7/1983 Smith ..... 34/506
4,644,854 A * 2/1987 Stouffer et al. ..... 454/125
4,694,992 A * 9/1987 Stouffer ..... 239/265.23
4,709,622 A * 12/1987 Stouffer et al. ..... 454/125
4,774,975 A * 10/1988 Ayers et al. ..... 134/168 C
4,823,682 A * 4/1989 Stouffer ..... 454/127
5,259,815 A * 11/1993 Stouffer et al. ..... 454/125
5,749,161 A * 5/1998 Jones ..... 34/541

FOREIGN PATENT DOCUMENTS

JP 360137462 A * 7/1985

(Continued)

OTHER PUBLICATIONS

"Self-Induced Oscillation of a Jet Issued from a Flip-Flop Jet Nozzle", T. Koso et al., Oct. 2, 2000.*

(Continued)

*Primary Examiner*—Harold Joyce
(74) *Attorney, Agent, or Firm*—Antonelli, Terry, Stout and Kraus, LLP.

(57) ABSTRACT

An air shower for removing a particle from an object by blowing air to the object which includes at least one first outlet for discharging the air from the at least one first outlet toward at least a portion of the object so that a flow axis of the air flowing out of the at least one first outlet is swung frequently and alternately in a first swingable direction, and at least one second outlet for discharging the air from the at least one second outlet so that a flow axis of the air flowing out of the at least one second outlet is swung frequently and alternately in a second swingable direction which is different from the first swingable direction. The first swingable direction and the second swingable direction extend so as to be non-parallel to one another and to intersect one another.

18 Claims, 9 Drawing Sheets

FOREIGN PATENT DOCUMENTS

| | | | |
|---|---|---|---|
| JP | 62-76848 | * | 5/1987 |
| JP | 63-165437 | * | 10/1988 |
| JP | 404032639 A | * | 2/1992 |
| JP | 06-193958 | * | 7/1994 |
| JP | 10-052654 | * | 2/1998 |

OTHER PUBLICATIONS

"Evaluation of Flip-Flop Jet Nozzles for Use as Practical Excitation Devices", G. Raman et al., Transacations of the ASME, 508/vol., 116, Sep. 1994.*

* cited by examiner

CROSS-SECTION
ALONG B-B

NON-FLOW VIBRATING NOZZLE

FLOW VIBRATING NOZZLE

FLOW VIBRATING NOZZLE

AIR SHOWER APPARATUS

CROSS REFERENCE TO RELATED APPLICATION

This application is a continuation of U.S. application Ser. No. 10/382,834, filed Mar. 7, 2003 now U.S. Pat. No. 6,960,128, and is copending with U.S. application Ser. No. 10/873,185, filed Jun. 23, 2004, which is a continuation of U.S. application Ser. No. 10/382,834, filed Mar. 7, 2003 the contents of which are incorporated herein by reference.

BACKGROUND OF THE INVENTION

The present invention relates to an air shower apparatus for blowing an air toward an object.

JP-A-10-52654 discloses a pulsed air jet generator in which a passage or opening area of the air is alternately open-and-closed or increased-and-decreased by a mechanical shutter or flow restriction throttle to generate a pulsed air jet.

JP-A-06-193958 discloses an air blowing device with an air flow direction deflector in which deflector a member is movable in a direction perpendicular to an air flow direction to adjust directing a part of the air to be applied to a directing surface on which Coanda effect is obtained to emphasize a deflection of the air flow by the directing surface so that another part of the air is prevented from being deflected by the directing surface and the part of the air is deflected strongly by the directing surface.

JP-U-63-165437 and JP-U-62-76848 disclose air shower devices in each of which an air injection nozzle is swung to deflect the air flow.

BRIEF SUMMARY OF THE INVENTION

An object of the present invention is to provide an air shower apparatus for blowing an air, in which apparatus a flow direction of the air is capable of being deflected frequently without a movable member contacting the air to be deflected or extending through the air to be deflected.

An air shower apparatus for blowing an air, comprises, an inlet duct for guiding the air so that the air flowing out from the inlet duct is directed along a first flow axis of the air, and a variable condition area adapted to communicate fluidly with the air flowing out from the inlet duct at at least one side in a direction perpendicular to the first flow axis, to generate a fluctuation at the variable condition area in at least one of a pressure to be applied to the air flowing out from the inlet duct at the variable condition area and a mass flow rate of a supplemental air to be applied from the variable condition area onto the air flowing out of the inlet duct in a fluctuating direction oblique to the first flow axis so that a second flow axis of the air passing the variable condition area is frequently deflected from the first flow axis by the fluctuation in at least one of the pressure and the mass flow rate in the fluctuating direction.

Since the second flow axis of the air passing the variable condition area is frequently deflected from the first flow axis by the fluctuation in at least one of the pressure and the mass flow rate in the fluctuating direction applied from the variable condition area at the at least one side in the direction, a flow direction of the air can be deflected frequently without a "movable" member contacting the air to be deflected or extending through the air to be deflected.

It is preferable for enlarging the deflection of the second flow axis by utilizing Coanda effect that the air shower apparatus further comprises an outlet duct arranged at a downstream side with respect to the variable condition area in an air flow direction from the inlet duct toward the variable condition area, the outlet duct includes an axial area along the first flow axis in which axial area a distance between an inner surface of the outlet duct and the first flow axis in the direction increases in the air flow direction, and the first flow axis passes through a minimum air flow opening area of the outlet duct along a transverse imaginary plane perpendicular to the first flow axis so that Coanda effect is generated along the inner surface of the outlet duct. It is preferable for maximizing the deflection of the second flow axis that the distance between the inner surface of the outlet duct and the first flow axis in another direction perpendicular to the direction is prevented from increasing in the air flow direction within the axial area so that the air passing the axial area is restrained from being expanded in the another direction.

It is preferable for minimizing a pressure loss in the air shower apparatus by utilizing a diffuser effect that the variable condition area has an enlarged air flow opening area along the transverse imaginary plane, the enlarged air flow opening area is larger than the minimum air flow opening area of the outlet duct, and the minimum air flow opening area of the outlet duct is larger than a minimum air flow opening area of the inlet duct along the transverse imaginary plane. It is preferable for minimizing the pressure loss and enlarging the deflection of the second flow axis that the whole of the minimum air flow opening area of the inlet duct is overlapped by the minimum air flow opening area of the outlet duct as seen along the first flow axis, and/or that the whole of the minimum air flow opening area of the outlet duct is overlapped by the enlarged air flow opening area as seen along the first flow axis.

It is preferable for generating the fluctuation in at least one of the pressure and the mass flow rate in the fluctuating direction by utilizing effectively Coanda effect and Venturi effect that in a cross-section of the inlet and outlet ducts in the apparatus along a longitudinal imaginary plane including the first flow axis and being parallel to the direction, an imaginary line extending parallel to the first flow axis from an inner surface of the inlet duct at the minimum air flow opening area of the inlet duct passes a radially inner side with respect to an inner surface of the outlet duct at the minimum air flow opening area of the outlet duct at the at least one side.

It is preferable for enlarging effectively the deflection of the second flow axis in the direction that a diameter of the minimum air flow opening area of the outlet duct in the direction is smaller than a diameter of the minimum air flow opening area of the outlet duct in another direction perpendicular to the direction.

It is preferable for enlarging effectively the deflection of the second flow axis that the outlet duct has a Venturi-type inner surface so that that a Venturi effect is obtainable at an upstream side with respect to the minimum air flow opening area of the outlet duct in the air flow direction to generate the supplemental air flow from the variable condition area in the fluctuating direction to be applied to the air flowing into the outlet duct from the variable condition area. It is preferable for generating the fluctuation in the mass flow rate of the air in the fluctuating direction without the movable member contacting the air to be deflected and/or the supplemental air or extending through the air to be deflected and/or the supplemental air that the fluctuation in the mass flow rate of the air in the fluctuating direction is obtainable by the air flow in the fluctuating direction generated by the Venturi effect.

It is preferable for enlarging effectively the deflection of the second flow axis that the variable condition area is adapted to communicate fluidly with the air flowing out from the inlet duct at each of the sides opposite to each other in the direction in such a manner that an air pressure at one of the sides is relatively low when an air pressure at the other one of the sides is relatively high.

It is preferable for enlarging effectively the deflection of the second flow axis and generating the frequent fluctuation in the mass flow rate of the air in the fluctuating direction without the movable member contacting the air to be deflected and/or the supplemental air or extending through the air to be deflected and/or the supplemental air that the variable condition area is adapted to communicate fluidly with the air flowing out from the inlet duct at each of the sides opposite to each other in the direction, and the variable condition area has a bypass passage for fluidly connecting the sides to each other while bypassing the variable condition area so that the air is capable of flowing through the bypass passage to decrease a difference in pressure between the sides.

It is preferable for generating the frequent fluctuation in the mass flow rate of the air in the fluctuating direction without the movable member contacting the air to be deflected and/or the supplemental air or extending through the air to be deflected and/or the supplemental air that the air shower apparatus comprises an air supply passage fluidly communicating with the variable condition area to compensate a change in pressure of the air generated at the at least one side or to generate a change in pressure of the air generated at the at least one side.

If the frequent fluctuation in the mass flow rate of the air in the fluctuating direction is generated without the movable member contacting the air to be deflected and/or the supplemental air or extending through the air to be deflected and/or the supplemental air, the whole of the minimum air flow opening area of the inlet duct is seeable through the minimum air flow opening area of the outlet duct as seen in a direction opposite to the air flow direction and along the first flow axis, all the time when the fluctuation is generated, and/or the inlet duct and the variable condition area are stationary with respect to each other in position and attitude, and/or that the inlet duct, the variable condition area and the outlet duct are stationary with respect to each other in position and attitude.

It is preferable for generating the frequent fluctuation in the mass flow rate of the air in the fluctuating direction without the movable member contacting the air to be deflected and/or the supplemental air or extending through the air to be deflected and/or the supplemental air that the second flow axis is movable away from the inner surface of the outlet duct by the fluctuation in at least one of the pressure and the mass flow rate in the fluctuating direction against the Coanda effect.

The air shower apparatus may further comprise a flow vibration generator (for example, a rotary fan, a fluidal switching device, a self-exciting fluidal oscillating circuit or the like) for changing a mass flow rate of the supplemental air to be supplied to the variable condition area so that the fluctuation in at least one of the pressure and the mass flow rate in the fluctuating direction is generated at the variable condition area.

Other objects, features and advantages of the invention will become apparent from the following description of the embodiments of the invention taken in conjunction with the accompanying drawings.

DETAILED DESCRIPTION OF THE INVENTION

Figure 1A:
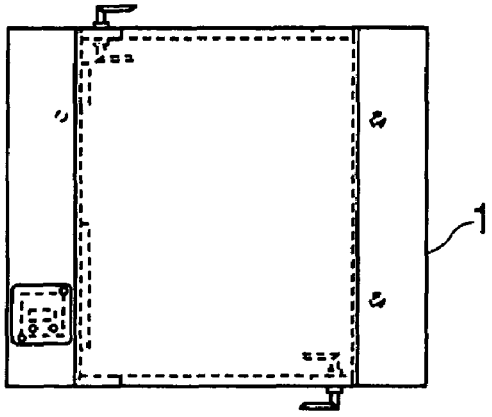
FIG. 1 is a combination of a front view (b), side view (c) and upper view (a) of an embodiment of an air shower apparatus of the invention.
Figure 1B:
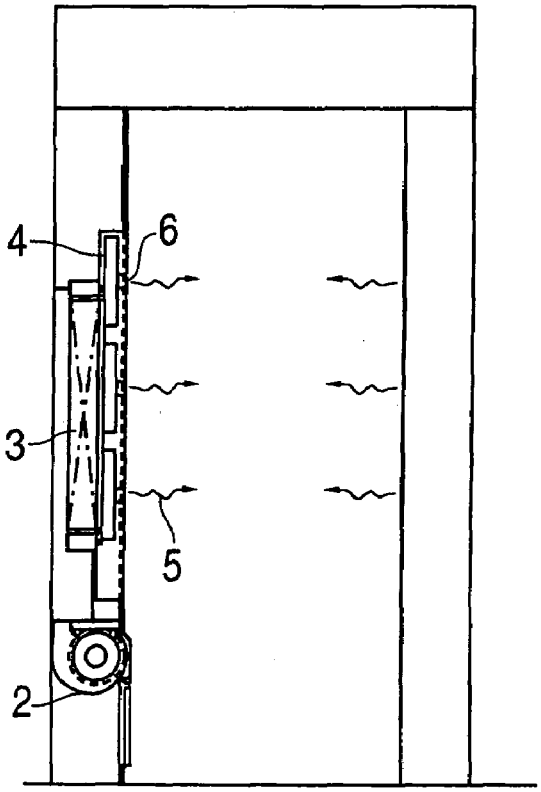
Figure 1C:
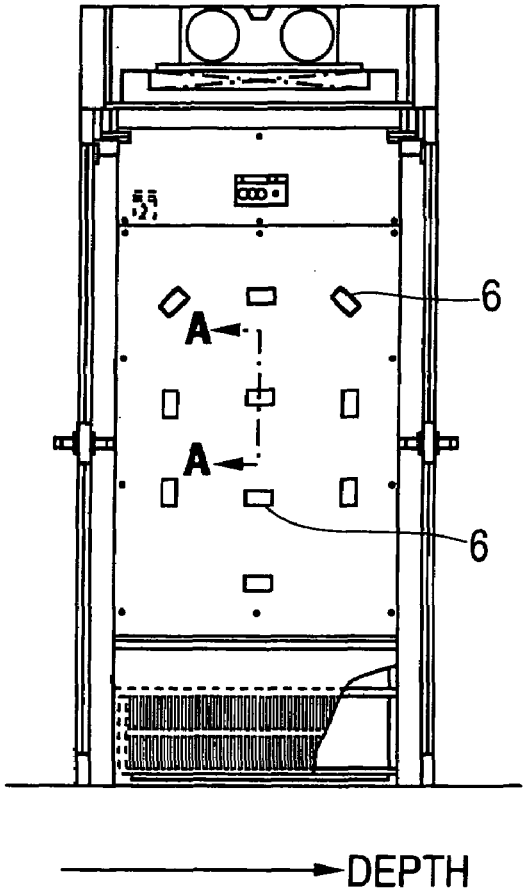

In an air shower apparatus of the invention as shown in FIG. 1, an air pressurized by an air blower 2 passes through a filter 3 for cleaning the air and is blown into an inside of the air shower apparatus as an injected air flow 5 from an inner wall of the inside of the air shower apparatus extending flatly from an outer periphery of a rectangular outlet 6 of each of air flow directing devices 4 as a main component of the air shower apparatus of the invention. The air flow directing devices 4 are arranged in such a manner that two or three stages in each of which stages three or four of the air flow directing devices 4 are aligned vertically are aligned horizontally. The rectangular outlets 6 of the uppermost air flow directing devices 4 positioned at left and right horizontal ends of the stages are obliquely arranged with respect to the other rectangular outlets 6 of the air flow directing devices 4. Directions of the air discharged from the air flow directing devices 4 may be different from each other, and the direction of swinging of the air flow discharge is represented by the double headed arrow shown in the proximity of the rectangular outlets 6 of the air flow direction devices 4 in FIGS. 2 and 3, for example.

Figure 2:
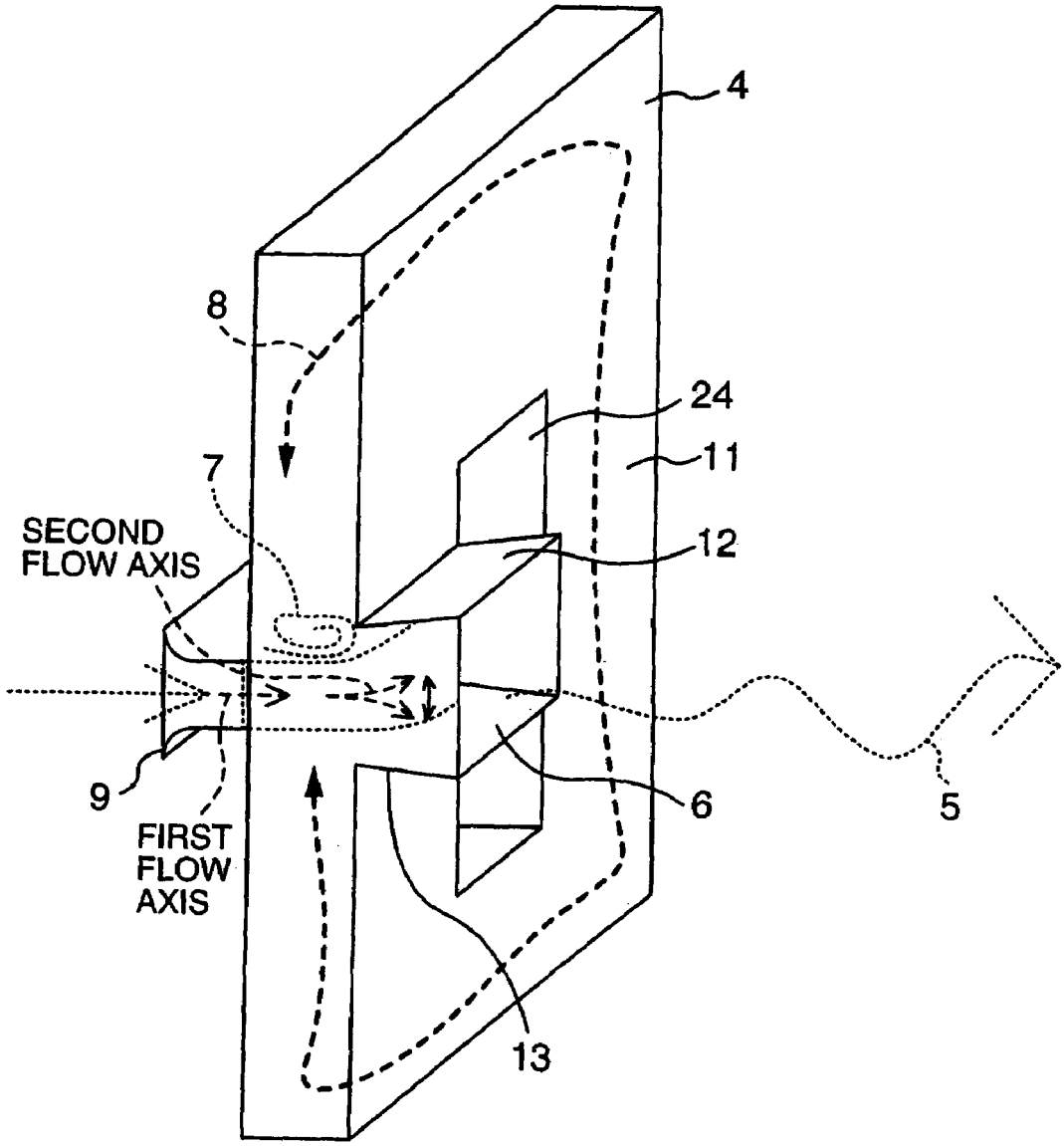
FIG. 2 is a schematic oblique projection view showing a main component of the air shower apparatus of the invention.
Figure 3A:
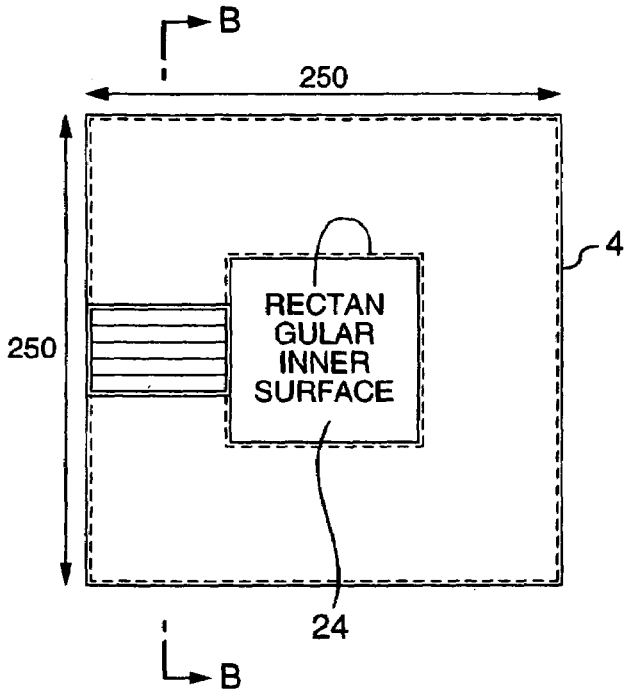
FIG. 3 is a combination of a front view of the main component as seen in a direction opposite to a flow direction of an air flowing out of an inlet duct, and a cross-sectional view thereof taken along an imaginary plane including a flow axis of the air directed by the inlet duct.
Figure 3B:
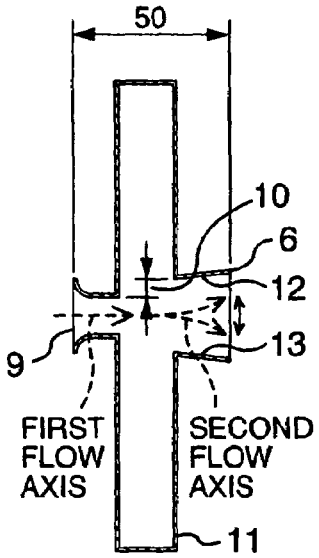

As shown in FIGS. 2 and 3, the air flow directing device 4 has an outer approximate dimension of H 250 mm×W 250 mm×D 50 mm, and includes an inlet duct 9, a chamber duct 11 (including the claimed variable condition area) and an outlet duct 6. The inlet duct 9 has a curved or tapered inner surface of curvature radius 7 mm and axial length 7 mm and a straight inner surface of axial length 7 mm opening to the chamber duct 11 so that the air flowing out from the inlet duct 9 toward the chamber duct 11 is directed along a first flow axis. The chamber duct 11 extends in such a manner that both longitudinal ends thereof are capable of communicating fluidly to the air flowing out of the inlet duct 9 at respective sides opposite to each other in a direction perpendicular to the first flow axis. The chamber duct 11 is hermetically sealed to prevent a fluidal communication between inside and outside thereof at a region other than the both longitudinal ends thereof. The outlet duct 6 has inner surfaces 12 and 13 on which a distance between the inner surface 12 or 13 of the outlet duct 6 and the first flow axis in the direction increases in the air flow direction, and an upstream end of the inner surface 12 and/or 13 of the outlet duct 6 is arranged in such a manner that the air flowing out from the inlet duct 9 to the chamber duct 11 easily reaches or adheres to the inner surface 12 or 13 of the outlet duct 6 by Coanda effect while an axial length of the inner surface 12 and/or is 13 of the outlet duct 6 is sufficient for holding stably the air to be discharged from the outlet duct 6, onto the inner surface 12 or 13 of the outlet duct 6 by the Coanda effect. The upstream end (minimum air flow opening area) of each of the inner surfaces 12 and 13 of the outlet duct 6 forms a step shape 10 with respect to a minimum air flow opening area of the inlet duct 9, and the minimum air flow opening area of the outlet duct 6 is greater than the minimum air flow opening area of the inlet duct 9.

When the air flowing out of the inlet duct 9 is adhered to or reaches securely one of the inner surfaces 12 and 13 by the Coanda effect after the air flowing out of the inlet duct 9 is drawn toward the one of the inner surfaces 12 and 13 of the outlet duct 6 by the Coanda effect, a vortex 7 is generated at the step shape 10 so that a supplemental air flow 8 flows from the chamber duct 11 into the air flowing into the outlet duct 6 to urge the air flowing out of the inlet duct 9 away from the one of the inner surfaces 12 and 13 toward another one of the inner surfaces 12 and 13. When the air flowing out of the inlet duct 9 is adhered to or reaches securely the another one of the inner surfaces 12 and 13 by the Coanda effect after the air flowing out of the inlet duct 9 is drawn toward the another one of the inner surfaces 12 and 13 of the outlet duct 6 by the supplemental air flow 8 and the Coanda effect, the vortex 7 is generated at the step shape 10 so that the supplemental air flow 8 flows from the chamber duct 11 into the air flowing into the outlet duct 6 to urge the air flowing out of the inlet duct 9 away from the another one of the inner surfaces 12 and 13 toward the one of the inner surfaces 12 and 13. These operations are repeated to frequently deflect alternately a second flow axis of the air flowing out of the outlet duct 6 from the first flow axis.

Figure 4:
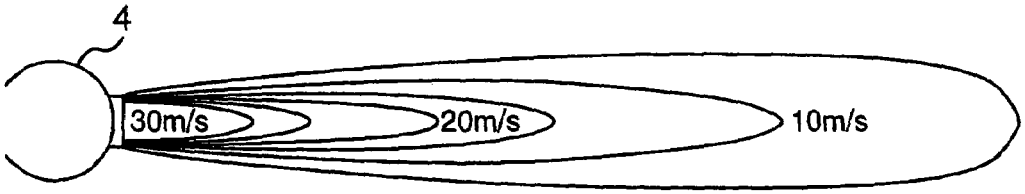
FIG. 4 is a schematic view showing an air flow obtainable by a stationary or non-flow-vibrating nozzle or duct.
Figure 5:
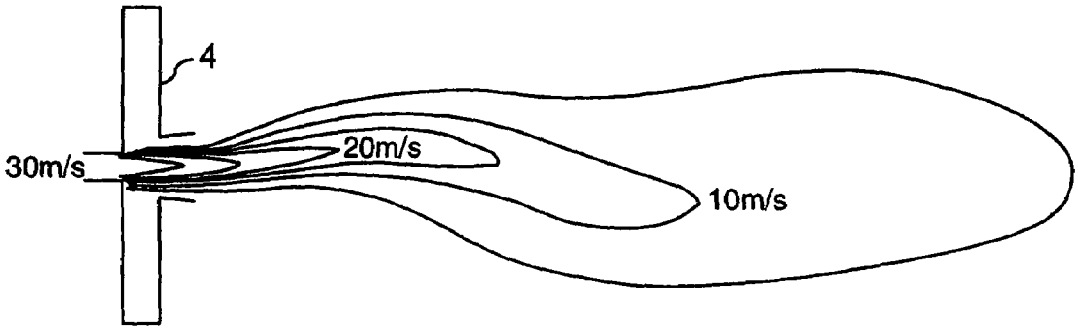
FIG. 5 is a schematic view showing an air flow obtainable by the main component of the air shower apparatus of the invention.

As understood from FIGS. 4 and 5, the air flow discharged from the outlet duct 6 of the invention swings in the direction of the double is headed arrow, as shown in FIG. 3, frequently and alternately by a significantly large distance or angle in comparison with a non-flow vibrating nozzle. A frequency of the swing of the air flow is determined in accordance with a longitudinal length of the chamber duct 11, the minimum air flow opening areas of the inlet and outlet ducts 9 and 6 and so forth.

Figure 6A:
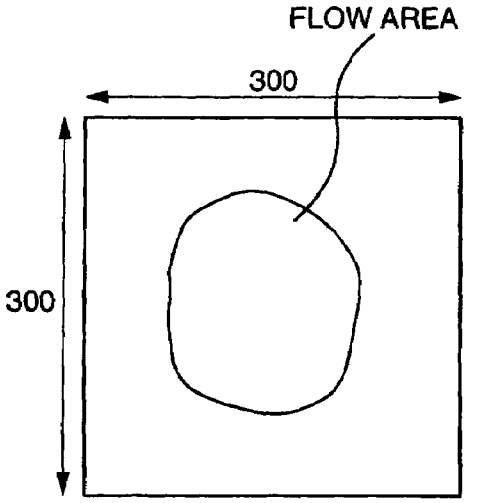
FIG. 6 is a combination of a schematic view showing an area to which the air blown by the stationary or non-flow-vibrating nozzle or duct reaches and a schematic view showing an area to which the air blown by the main component of the air shower apparatus of the invention reaches.
Figure 6B:
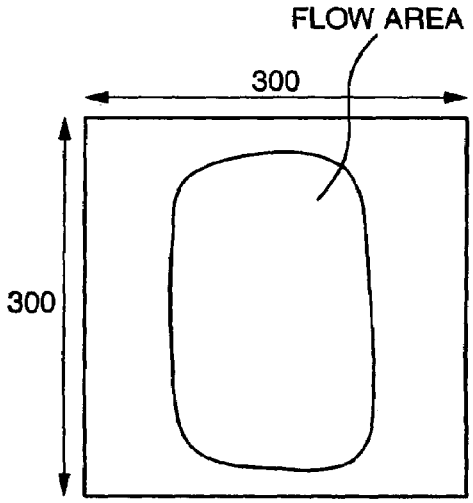
Figure 7:
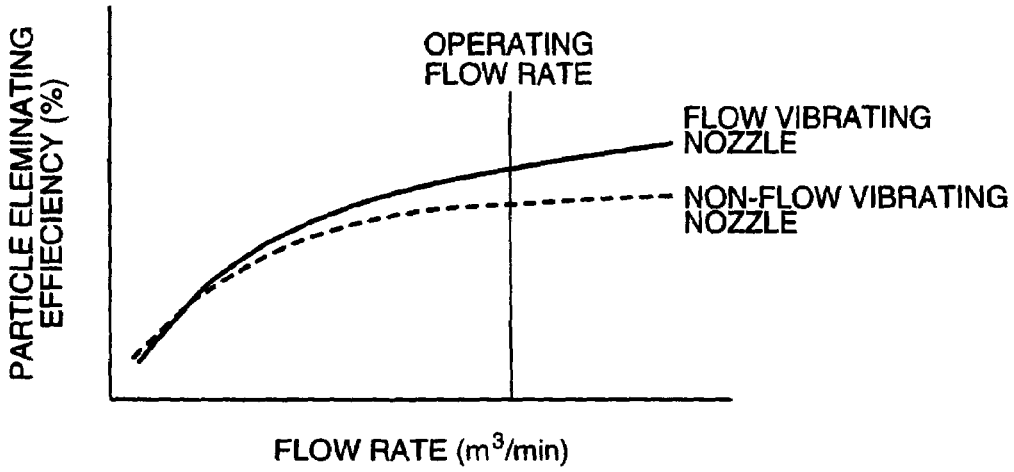
FIG. 7 is a diagram showing relationships between air flow rate and particle eliminating efficiency obtained by the stationary or non-flow-vibrating nozzle or duct and the main component of the air shower apparatus of the invention.

As understood from FIG. 6, an area or length of an object to which the swung air flow is applied from the air flow directing devices 4 of the invention as the flow vibrating nozzle is significantly greater in comparison with the non-flow vibrating nozzle. Further, a direction in which the swung air flow reaches the object from the air flow directing devices 4 of the invention varies frequently and alternately. Therefore, a particle eliminating efficiency is improved as shown in FIG. 7.

It is preferable for strongly removing the particle from the object that a velocity of the air discharged from the air flow directing devices 4 is not less than 18 m/s, and the frequency is as low as possible. It is preferable for widely removing the particle from the object that the area or length of an object to which the swung air flow is applied from the air flow directing devices 4 is as great as possible.

Figure 8A:
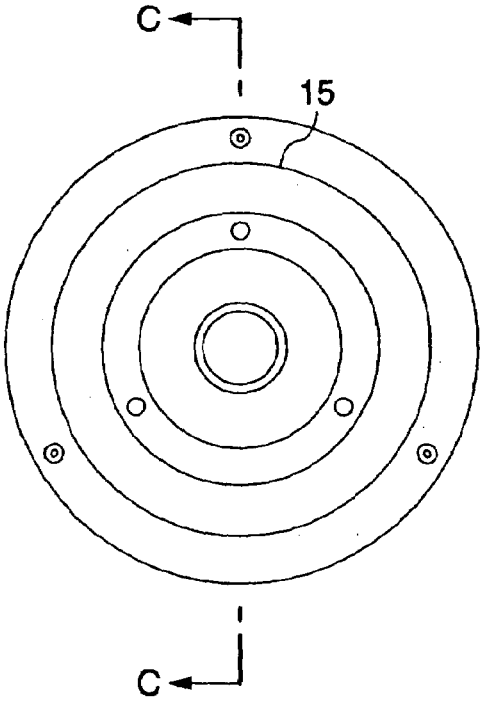
FIG. 8(a) PRIOR ART
FIG. 8 is a combination of a front view, a first cross-sectional side view and a second cross-sectional side view of the non-flow-vibrating nozzle or duct of the prior art.
Figure 8B:
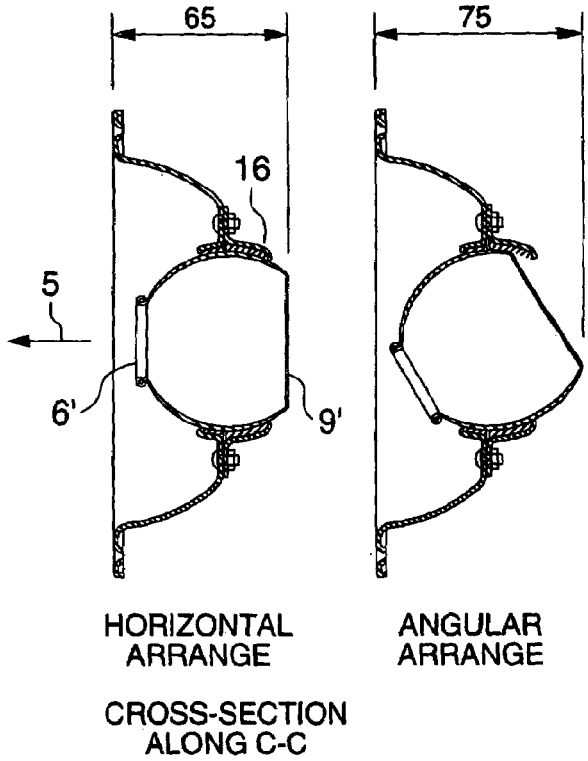
FIG. 8(b) PRIOR ART
Figure 9:
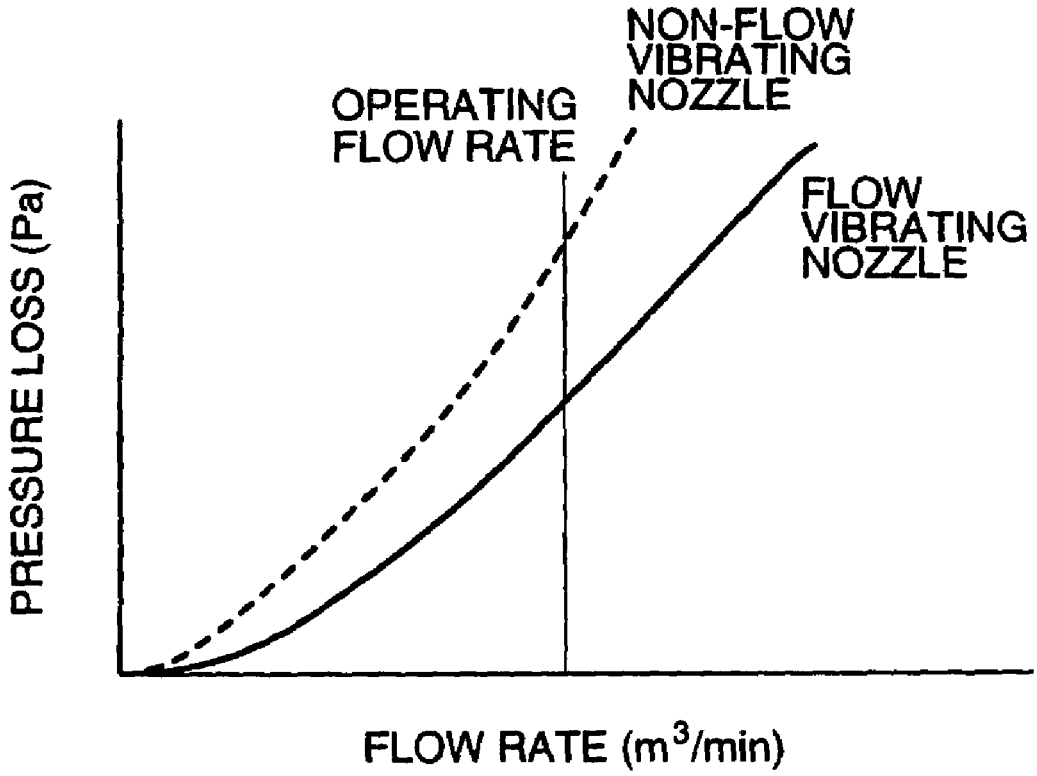
FIG. 9 is a diagram showing relationships between air flow rate and pressure loss obtained by the stationary or non-flow-vibrating nozzle or duct and the main component of the air shower apparatus of the invention.

Since the minimum air flow opening area of the outlet duct 6 is greater than the minimum air flow opening area of the inlet duct 9 to bring about a diffuser effect, a pressure loss in the air flow directing devices 4 is decreased in comparison with the prior art air nozzle as shown in FIG. 8, as shown in FIG. 9.

Figure 10:
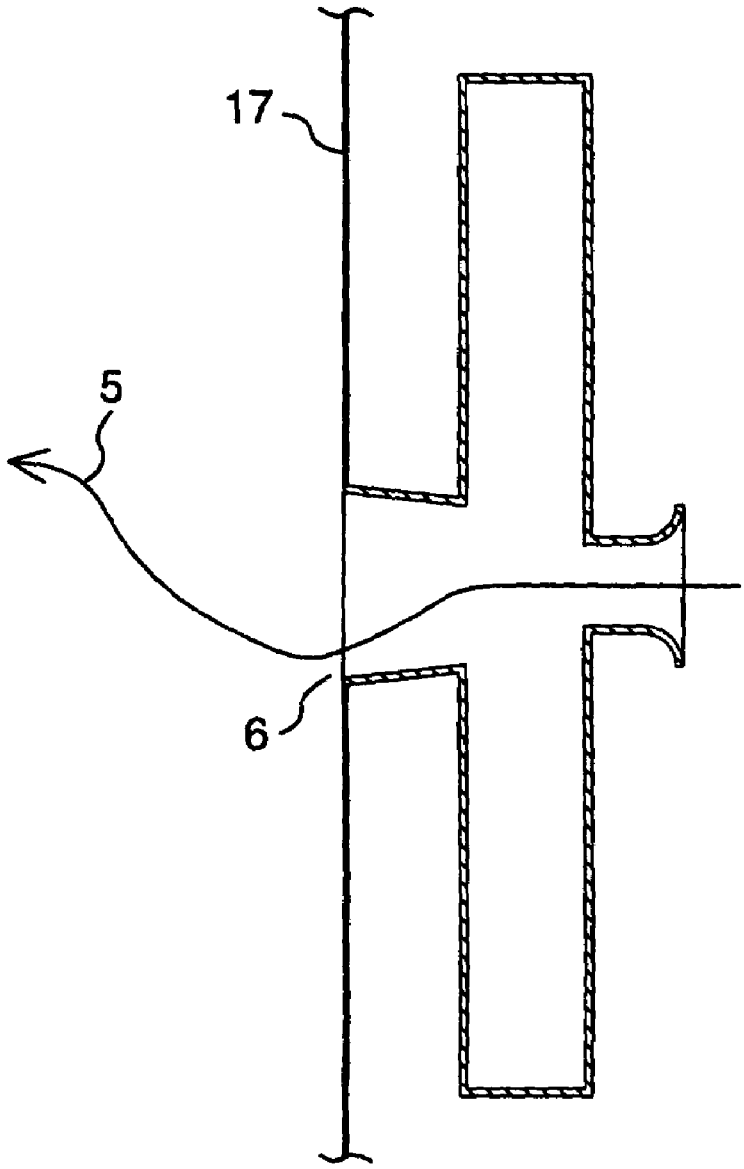
FIG. 10 is a cross sectional view showing the main component of the air shower apparatus of the invention mounted on a main body of the air shower apparatus.

As shown in FIG. 10, the inner wall of the inside of the air shower apparatus may extend flatly from the outer periphery of the outlet of the air flow directing devices 4 to restrain the particle from remaining on the inner wall.

If the swing of the air flow by the air flow directing devices 4 is obtained when a mass flow rate of the air decreasing in accordance with to an increase of pressure loss across the filter 3 caused by an increase of plugging of the filter 3 is not less a lower limit of mass flow rate corresponding to unacceptable increase of plugging of the filter 3 and the pressure of the air pressurized by the blower 2 is kept as constant as possible, and the swing of the air flow by the air flow directing devices 4 is not obtained when the mass flow rate of the air is less than the lower limit of mass flow rate and the pressure of the air pressurized by the blower 2 is kept as constant as possible, whether or not the unacceptable plugging of the filter 3 occurs can be judged from the swing of the air flow by the air flow directing devices 4.

Figure 11:
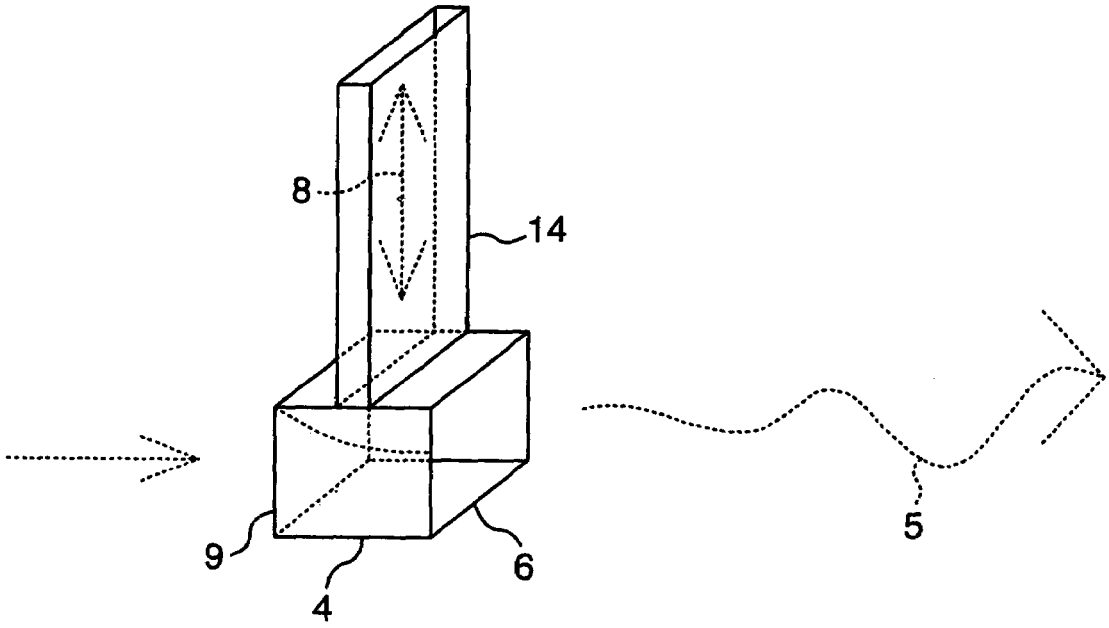
FIG. 11 is a schematic oblique projection view showing another main component of the air shower apparatus of the invention.
Figure 12:
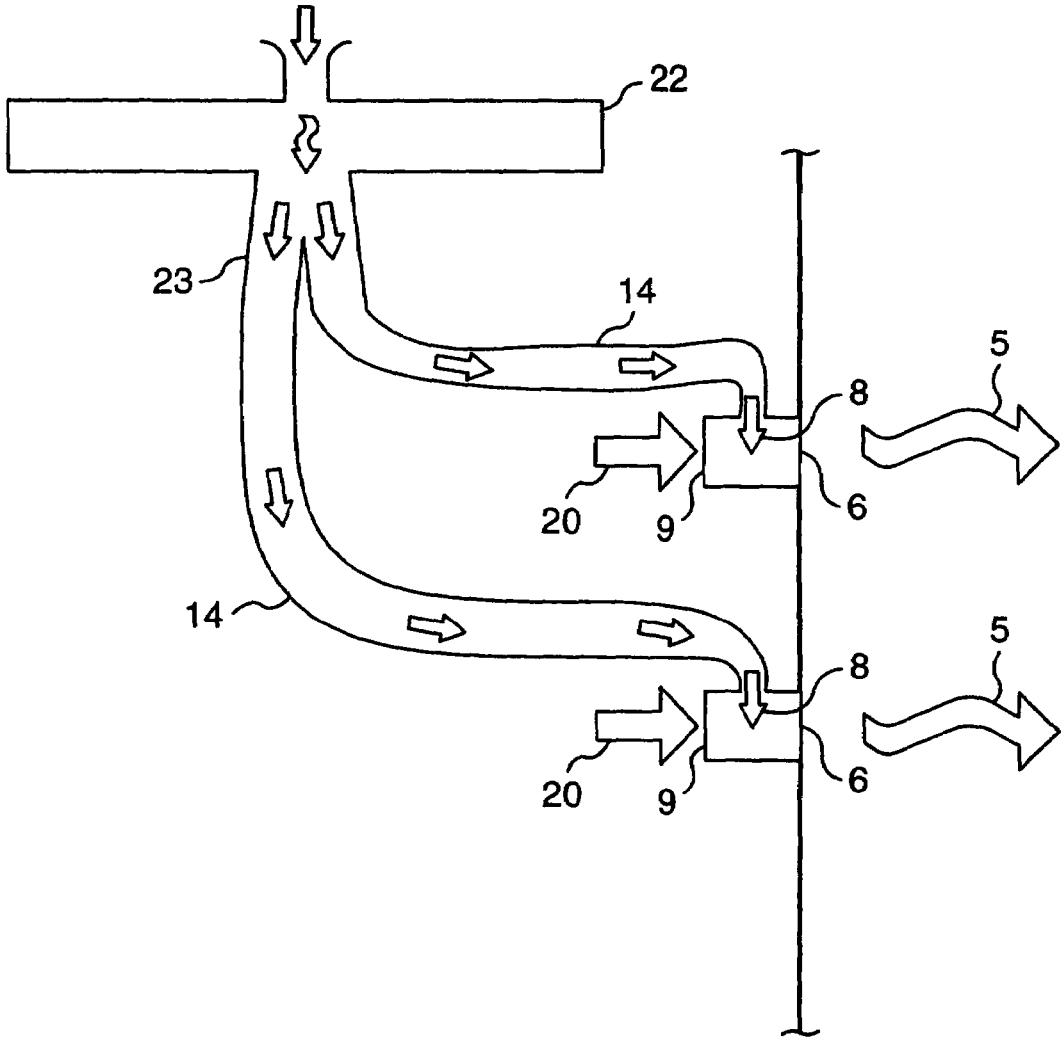
FIG. 12 is a schematic cross sectional view showing another air shower apparatus of the invention including the another main component.

As shown in FIG. 11, the supplemental air flow 8 may be generated to deflect the air flow in a chamber duct 14 (including the claimed variable condition area at one of the sides opposite to each other in the direction perpendicular to the first flow axis) communicating fluidly with the air between the inlet and outlet ducts 9 and 6, by, for example, a rotary fan for generating a pulsed and pressurized air flow as the supplemental air flow 8 or a swung air flow generator 22 similar to the air flow directing devices 4. As shown in FIG. 12, a diverging path 23 includes an inlet connected to an outlet duct of the swung air flow generator 22 and at least two outlets for receiving temporarily the swung air flow to distribute the swung air flow from the swung air flow generator 22 between the at least two outlets so that the pulsed supplemental air flow 8 is generated in each of the outlets of the diverging path 23. Each of the outlets of the diverging path 23 is fluidly connected to the chamber duct 14 to apply frequently the pulsed supplemental air flow 8 to the air flow 20 flowing from the inlet duct 9 into the outlet duct 9 to deflect or swing the second axis of the air flow 20 from the first axis of the air flow 20. A plurality of the chamber ducts 11 or 14 angularly or circumferentially distant from each other may be fluidly connected to the air flow directing devices 4 so that the air flow is deflected or swung in a plurality of radial directions in order. The pulsed air discharged from each of the outlets of the diverging path 23 may be supplied to the inside of the air shower apparatus without passing through the air flow directing devices 4.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. An air shower for removing a particle from an object by blowing air to the object, comprising:

at least one first outlet for discharging the air from the at least one first outlet toward at least a portion of the object so that a flow axis of the air flowing out of the at least one first outlet is swung frequently and alternately in a first swingable direction; and at least one second outlet for discharging the air from the at least one second outlet so that a flow axis of the air flowing out of the at least one second outlet is swung frequently and alternately in a second swingable direction which is different from the first swingable direction;

wherein the first swingable direction and the second swingable direction extend so as to be non-parallel to one another and to intersect one another; and wherein a frequency at which the flow axis of the air flowing out of the at least one first outlet is swung and a frequency at which the flow axis of the air flowing out of the at least one second outlet is swung are independent of each other.

2. An air shower according to claim 1, wherein the at least one first outlet and the at least one second outlet are adjacent to one another.

3. An air shower according to claim 2, wherein the at least one first outlet and the at least one second outlet are adjacent to one another in a radial direction of the at least one first outlet.

4. An air shower according to claim 1, wherein at least a portion of the air discharged from the at least one first and second outlets along the first swingable direction and the second swingable direction extend so as to intersect one another in a region of the object.

5. An air shower according to claim 1, further comprising at least one third outlet for discharging the air from the at least one third outlet toward the object so that a flow axis of the air flowing out of the at least one third outlet is swung frequently and alternately in a third swingable direction;

wherein at least the first swingable direction and the third swingable direction extend so as to intersect one another.

6. An air shower according to claim 5, wherein the first swingable direction and the second swingable direction extend so as to intersect with one another at one of sides of the first swingable direction which sides are opposed to each other about the at least one first outlet, and the first swingable direction and the third swingable direction extend so as to intersect one another at the one of the sides of the first swingable direction.

7. An air shower according to claim 5, wherein the first swingable direction, the second swingable direction and the third swingable direction extend so as to intersect one another.

8. An air shower according to claim 1, wherein the air discharged from the at least one first outlet and the at least one second outlet is at a velocity of at least 18 m/s.

9. An air shower according to claim 1, wherein a swing motion of the flow axis of the air flowing out of the at least one first outlet and a swing motion of the flow axis of the air flowing out of the at least one second outlet are asynchronous with respect to each other.

10. An air shower for removing a particle from an object by blowing air to the object, comprising:

at least one first outlet for discharging the air from the at least one first outlet toward at least a portion of the object so that a flow axis of the air flowing out of the at least one first outlet is swung frequently and alternately in a first swingable direction; and at least one second outlet for discharging the air from the at least one second outlet so that a flow axis of the air flowing out of the at least one second outlet is swung frequently and alternately in a second swingable direction which is different from the first swingable direction;

wherein the first swingable direction and the second swingable direction extend so as to be non-parallel to one another and to intersect one another;

wherein the at least one first outlet and the at least one second outlet simultaneously discharge the air along the first and second non-parallel swingable directions so as to dislodge and remove the particle on the object from the object; and wherein a frequency at which the flow axis of the air flowing out of the at least one first outlet is swung and a frequency at which the flow axis of the air flowing out of the at least one second outlet is swung are independent of each other.

11. An air shower according to claim 10, wherein the at least one first outlet and the at least one second outlet are adjacent to one another.

12. An air shower according to claim 11, wherein the at least one first outlet and the at least one second outlet are adjacent to one another in a radial direction of the at least one first outlet.

13. An air shower according to claim 10, wherein at least a portion of the air discharged from the at least one first and second outlets along the first swingable direction and the second swingable direction extend so as to intersect one another in a region of the object.

14. An air shower according to claim 8, further comprising at least one third outlet for discharging the air from the at least one third outlet toward the object so that a flow axis of the air flowing out of the at least one third outlet is swung frequently and alternately in a third swingable direction;

wherein at least the first swingable direction and the third swingable direction extend so as to intersect one another.

15. An air shower according to claim 14, wherein the first swingable direction and the second swingable direction extend so as to intersect with one another at one of sides of the first swingable direction which sides are opposed to each other about the at least one first outlet, and the first swingable direction and the third swingable direction extend so as to intersect one another at the one of the sides of the first swingable direction.

16. An air shower according to claim 14, wherein the first swingable direction, the second swingable direction and the third swingable direction extend so as to intersect one another.

17. An air shower according to claim 10, wherein the air discharged from the at least one first outlet and the at least one second outlet is at a velocity of at least 18 m/s.

18. An air shower according to claim 10, wherein a swing motion of the flow axis of the air flowing out of the at least one first outlet and a swing motion of the flow axis of the air flowing out of the at least one second outlet are asynchronous with respect to each other.

* * * * *